US011453529B1

(12) United States Patent
Troyan

(10) Patent No.: US 11,453,529 B1
(45) Date of Patent: Sep. 27, 2022

(54) METHOD AND APPARATUS TO EXTEND LIFE OF RECEPTACLE

(71) Applicant: Nomad Holdings 2, LLC, Rocky River, OH (US)

(72) Inventor: Damon Troyan, Rocky River, OH (US)

( * ) Notice: Subject to any disclaimer, the term of this patent is extended or adjusted under 35 U.S.C. 154(b) by 0 days.

(21) Appl. No.: 16/736,629

(22) Filed: Jan. 7, 2020

Related U.S. Application Data

(63) Continuation-in-part of application No. 29/680,154, filed on Feb. 13, 2019, now Pat. No. Des. 896,460, and a continuation-in-part of application No. 29/380,155, filed on Feb. 13, 2019, now Pat. No. Des. 896,461.

(51) Int. Cl.
*B65D 1/40* (2006.01)
*B65D 25/24* (2006.01)
*B65F 1/14* (2006.01)

(52) U.S. Cl.
CPC ..... *B65D 25/24* (2013.01); *B65F 1/14* (2013.01)

(58) Field of Classification Search
CPC ... B65D 25/24; B65F 1/02; B65F 1/14; B65F 1/1468
USPC ..... 220/630, 632, 908, 636, 729
See application file for complete search history.

(56) References Cited

U.S. PATENT DOCUMENTS

| | | | | |
|---|---|---|---|---|
| 5,251,780 | A | 10/1993 | Norman | |
| 6,439,418 | B1 * | 8/2002 | Immerman | B65D 25/24 220/626 |
| 8,464,897 | B2 | 6/2013 | Bloom | |
| 9,738,444 | B1 * | 8/2017 | Uffner | B65F 1/02 |
| 2007/0125788 | A1 * | 6/2007 | Petner | B65F 1/141 220/630 |
| 2007/0187417 | A1 * | 8/2007 | Wheeler | B65F 1/02 220/630 |

* cited by examiner

*Primary Examiner* — Don M Anderson
*Assistant Examiner* — Elizabeth J Volz
(74) *Attorney, Agent, or Firm* — FisherBroyles, LLP

(57) ABSTRACT

A method and apparatus are disclosed that includes providing a waste receptacle body and removably connecting a skid plate sized to cover a lower base of the receptacle, where the skid plate includes an opening through the skid plate sized to allow a user to lift the waste receptacle in part by the opening through the skid plate. A user observes wear on an exposed side of the skid plate over time and removes and flips the skid plate in response to the observed wear.

13 Claims, 6 Drawing Sheets

METHOD AND APPARATUS TO EXTEND LIFE OF RECEPTACLE

This disclosure is directed to the field of trash cans also referred to as waste receptacles or wastebaskets. It finds application, among others, in extending the life of such receptacles, especially ones made partially or entirely of polymeric materials. Aspects include methods and apparatus to attach and remove disposable skid plates on a lower surface of the waste receptacles to reduce or retard wear on the lower surface of the waste receptacle. Other aspects will be discussed below.

Many commercial establishments use waste receptacles made from polymeric materials. One particular receptacle in wide-spread use is a 23 gallon receptacle available from a variety of suppliers such as Lavex™, Rubbermaid™, Marko™ and others. While such receptacles often include single use disposable liner bags, in typical use the waste-loaded liners are not always removed and carried a dumpster or other collection point. Rather, often times the entire receptacle is dragged to the collection point for emptying. Repeated trips dragging the receptacle across hard flooring surfaces such as tile, cement or asphalt to empty the waste-loaded receptacle results in gradual wear on the lower surface of the receptacle and eventual failure including wear through of portions of the lower surface. Such failures allow leakage of waste—solid, liquid or both—along the path to the collection point requiring additional effort to clean the leakage, and frequent replacement of failed receptacles.

SUMMARY

Systems and methods are disclosed to extend the life of waste receptacles. In one aspect, a method comprises providing a waste receptacle body and connecting a skid plate sized to cover a lower base where the skid plate includes an opening through the skid plate sized to allow a user to lift the waste receptacle in part by the opening through the skid plate. The method includes observing wear on an exposed side of the skid plate over time, and removing and flipping the skid plate in response to the observed wear so that the exposed side is adjacent to the lower base.

In another aspect, a waste receptacle comprises a waste receptacle body including an upper, open side and an opposed lower base where the lower base includes a skirt around a periphery of the lower base. The waste receptacle also includes a skid plate sized to be removably received within the skirt around the periphery of the lower base and to cover the lower base within the skirt. The waste receptacle includes means for removably connecting the skid plate to the waste receptacle, such as a fastener strip, shaped key, post and connector or other connecting mechanisms.

DESCRIPTION OF THE FIGURES

These and other features, embodiments, and advantages of the present disclosure are better understood when the following Detailed Description is read with reference to the accompanying drawings.

DETAILED DESCRIPTION

This disclosure describes systems and methods for a new type of waste receptacle that may include a bottom comprising an integral or replaceable skid plate that is gradually sacrificed during use and eventually replaced. One advantage of the disclosed systems and methods is extending the life of the relatively expensive waste receptacles, while sacrificing and replacing only a relatively less expensive skid plate as needed. Other advantages permit the use of different, more durable materials in the comparatively small skid plate while allowing the body of the receptacle to be formed from conventional or less durable materials. While polymeric waste receptacles and discussed here to illustrate aspects of the disclosure, artisans will appreciate that the teachings can apply to waste receptacles made from other materials such as metal. Additionally, skid plates may be made to affix onto conventional, commercially available waste receptacles.

In one example, a waste receptacle includes a waste receptacle body including an upper, open side and an opposed lower base where the lower base includes a recessed space surrounded around a periphery by a portion of the lower base or, alternately an extension extending from the lower base, where the extension is also called a skirt. The receptacle also includes a skid plate sized to be removably received within the recessed space and to cover the lower base, or at least portions of the lower based contacting the floor, and means for removably connecting the skid plate to the waste receptacle.

Figure 1:
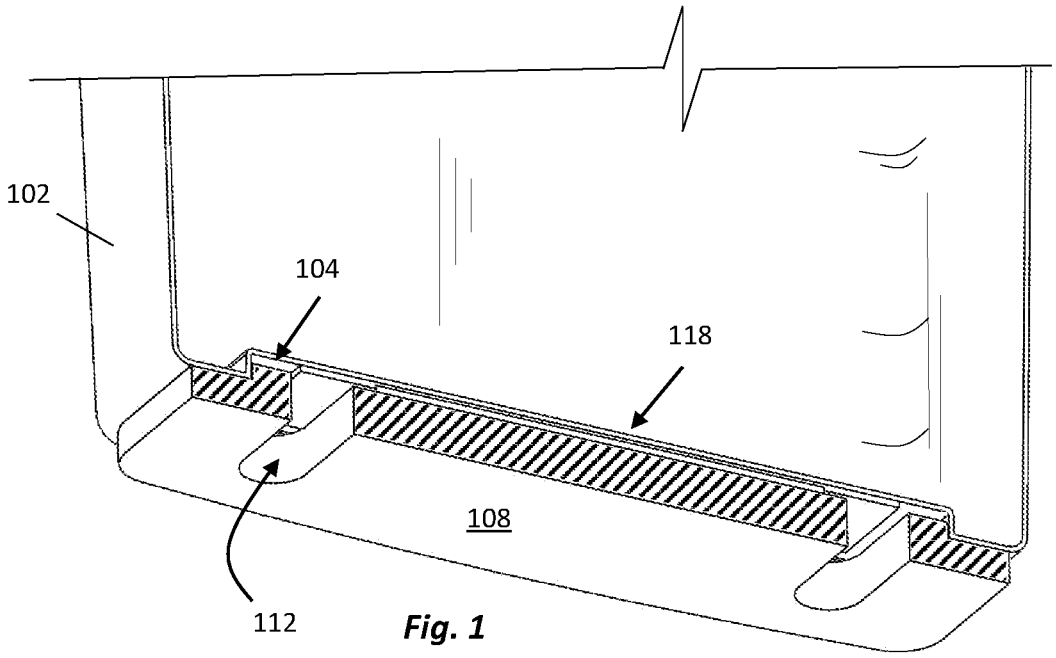
FIG. 1 illustrates a cross-sectional, partial bottom perspective view of one embodiment of a waste receptacle including one embodiment of a skid plate.
Figure 2:
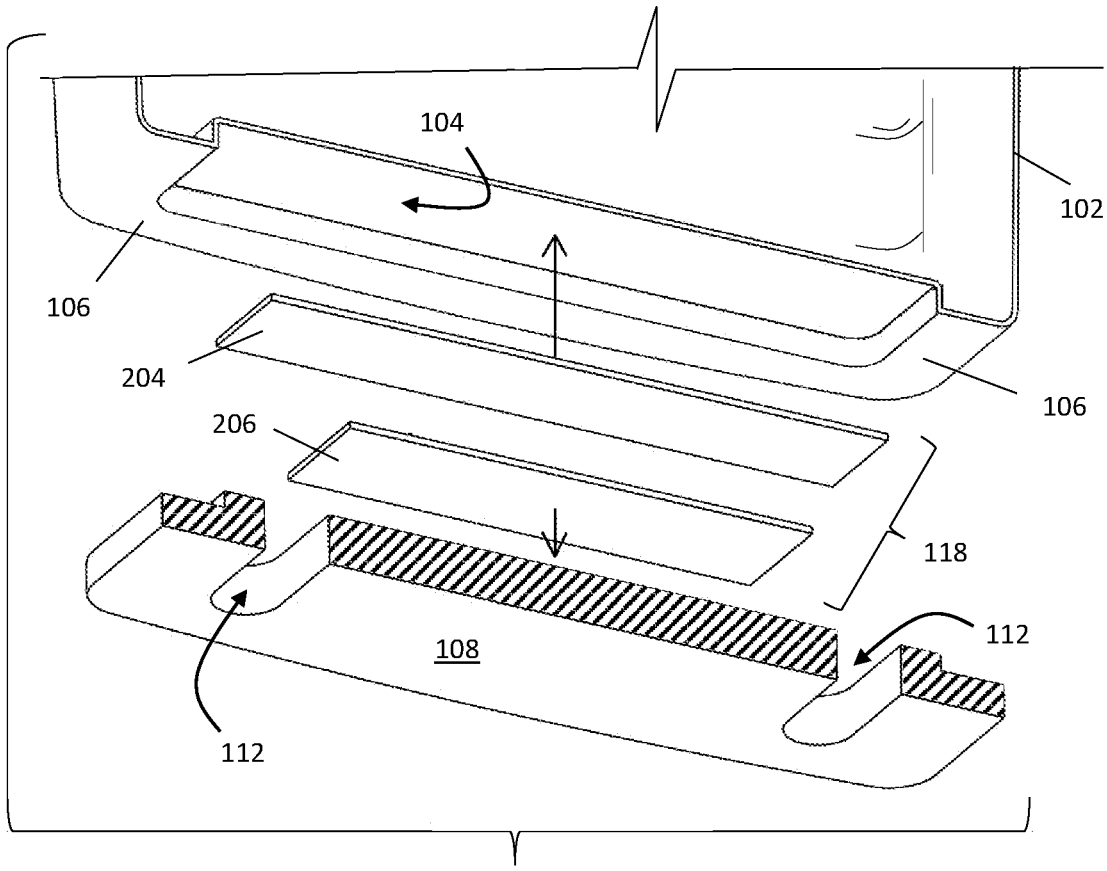
FIG. 2 illustrates an exploded, cross-sectional, partial bottom perspective view of the receptacle and skid plate of FIG. 1.

Referring now to FIGS. 1 and 2, a bottom side of a waste receptacle 102 includes a central recess 104 surrounding a periphery 106 of the bottom side of the receptacle. Often, when a user empties a receptacle, the receptacle is dragged on the floor, pavement, concrete or other surface to a larger collection point, dumpster, or the like. Over time, at least a portion of the periphery 106 wears through and fails leaking fluids or items from the receptacle onto the floor creating a mess, if not a hazard. As repairs are impossible or impracticable, partial receptacle failure results in the need to purchase a new receptacle to replace the failed unit. To avoid the hazards of leakage and the need to replace otherwise functional receptacles, a skid plate 108 sized to cover the periphery 106 is attached to the bottom side of the waste receptacle 102. The skid plate may optionally include a beveled edge or a rounded edge around the edge of the skid plate to reduce catching the edge while the receptacle is dragged to a collection point. The skid plate may optionally include grips 112 to facilitate a user lifting the receptacle for emptying. The grips can be formed as indents in the skid plate or as full depth interruptions in the skid plate 108 as illustrated. In the embodiment illustrated, means 118 for attaching the skid plate 108 to the receptacle 102 includes a first engaging hook and loop, mushroom head or other snap together type fastener strip 204 adhered to at least part of the waste receptacle 102, for example in the central recess 104 as illustrated. The means 118 includes a complementary strip 206 attached to the skid plate and when the fastener strips 204, 206 are engaged, the skid plate 108 is held in place on the bottom of the receptacle 102 and extends to the periphery 106. As the receptacle is used, the skid plate 108 rather than the bottom side of the receptacle wears. Optionally, after one side of the skid plate has worn, the skid plate and can be economically flipped to the other side and reused.

Figure 3:
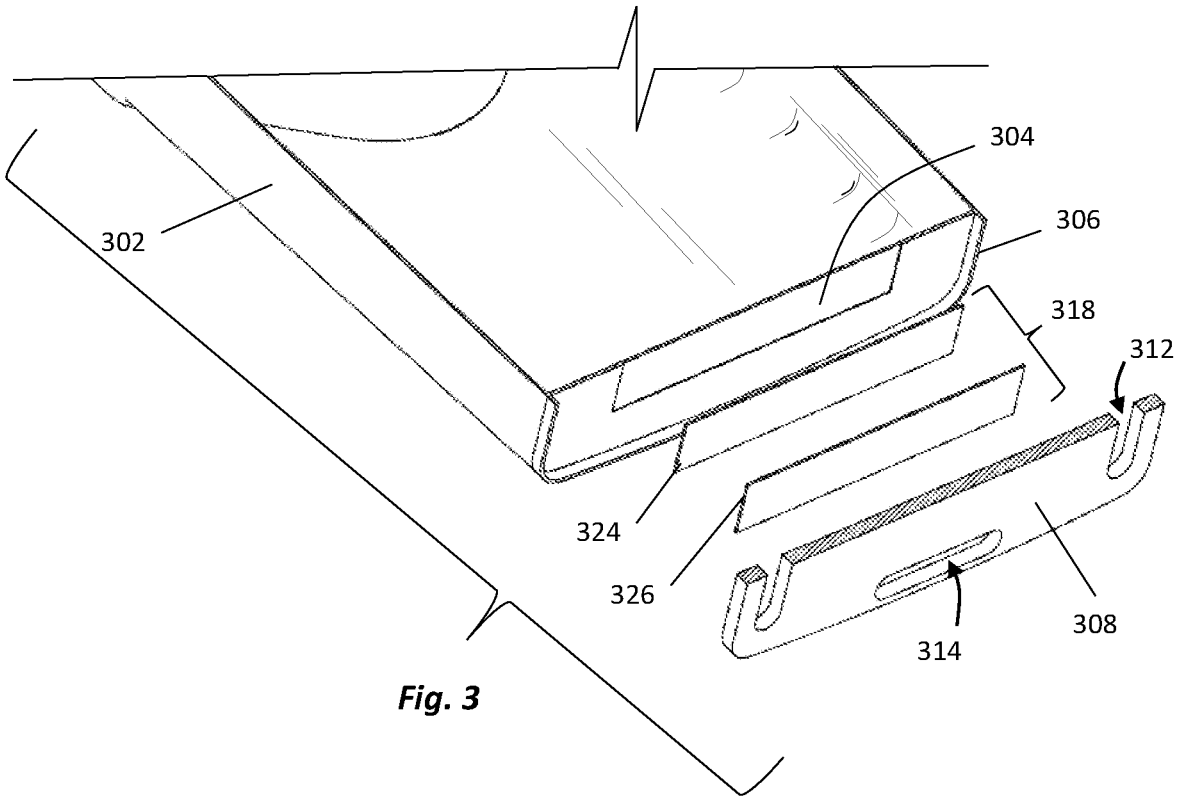
FIG. 3 illustrates an exploded, cross-sectional, partial bottom perspective view of another embodiment of a waste receptacle including an embodiment of a skid plate.

Referring now to FIG. 3, an alternate embodiment includes a waste receptacle 302 including a recess 304 and a skirt 306 molded or formed into the receptacle at a periphery of the bottom side of the receptacle 302. The recess 304 is sized to accommodate the means 318 for attaching a skid plate 308 to the receptacle 302. In the embodiment illustrated, the means 318 for attaching the skid plate 308 to the receptacle 302 includes a first strip 324 and a second complementary strip 326, such as hook and loop, mushroom head, other snap together type fasteners or double-sided adhesive tape, pressure sensitive adhesives, glue, other adhesive, or the like. In one embodiment, the recess 304 is sized to approximate the expected length, width and/or thickness of the means 318 for attaching the skid plate 308. Optionally, the skid plate may further include grips 312 on a short side of the skid plate and grips 314 on a longer side of the skid plate 308. When attached, the skid plate 308 is closely received inside the skirt 306 which acts to support the skid plate and provide additional resistance to skid plate lateral movement.

Figure 4:
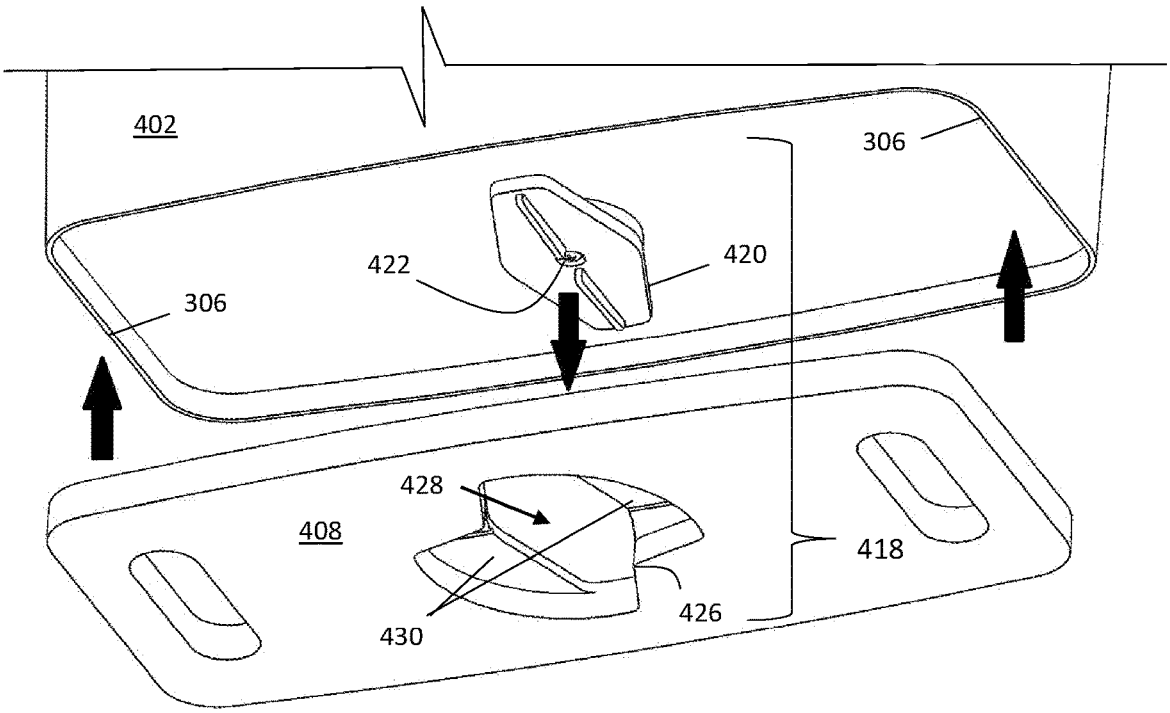
FIG. 4 illustrates an exploded, partial bottom perspective view of another embodiment of a waste receptacle including an embodiment of a skid plate.
Figure 5:
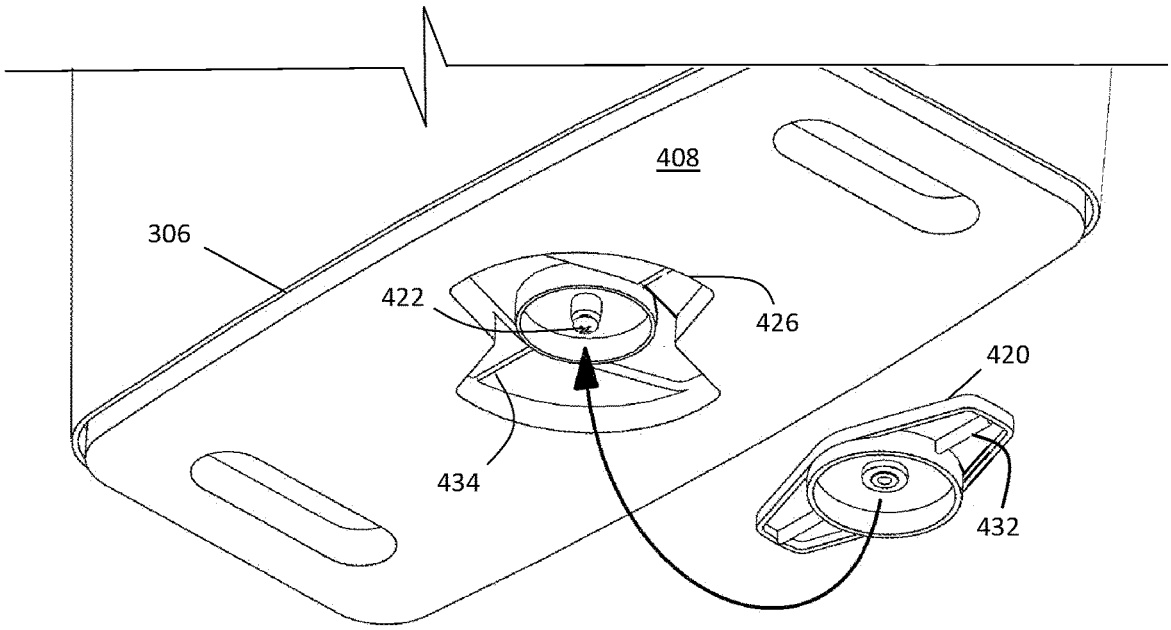
FIG. 5 illustrates a partially assembled, partial bottom perspective view of the receptacle and skid plate of FIG. 4.
Figure 6:
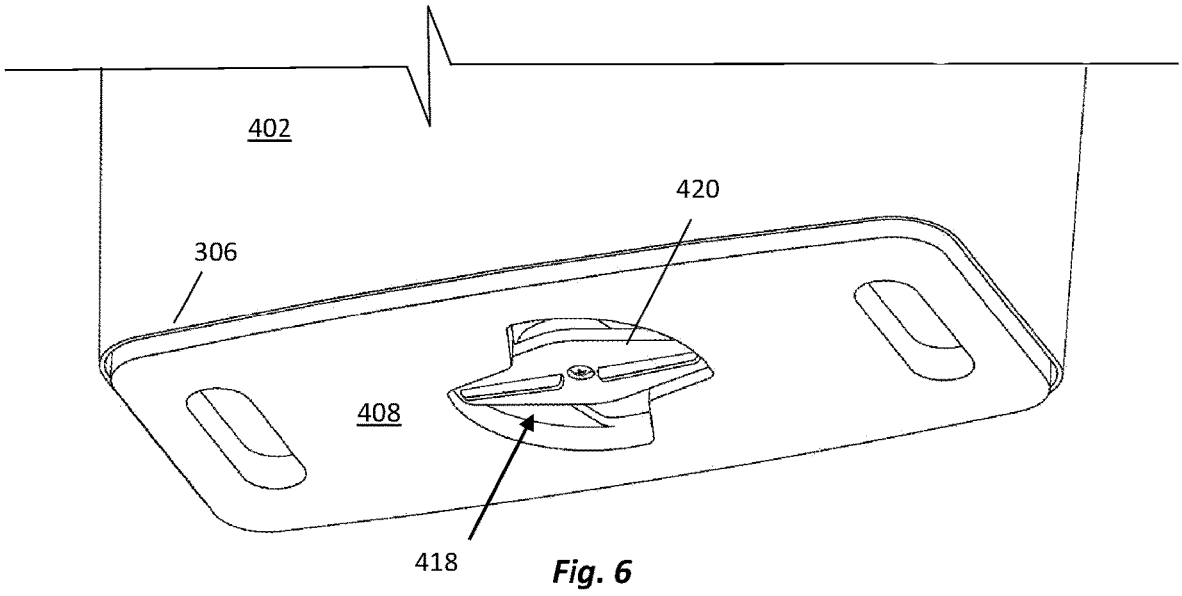
FIG. 6 illustrates a bottom perspective view of the receptacle and skid plate of FIG. 4.

Referring now to FIGS. 4-6, a bottom side of another embodiment of a waste receptacle 402 includes a skirt 306 around the peripheral bottom edge of the waste receptacle 402 sized accommodate an alternate skid plate 408 held in place at least partially by a means 418 for attaching the skid plate 408 to the receptacle 402. In the illustrated embodiment, the means 418 for attaching includes a rotatable, shaped key 420 attached to the bottom of the receptacle 402, for example by a screw 422 as seen. The means 418 for attaching further includes a lock 426 formed in the skid plate, where the lock 426 has an opening 428 through the skid plate 408 shaped to allow the key 420 to pass through the opening 428. The lock 426 further includes opposed, tapered shelves 430 to engage the key 420 when the key is inserted into the lock and rotated. The key 420 may also be formed with ridges 432 that engage with detents 434 in the shelves 430 to discourage unintentional rotation of the key within the lock 426.

Figure 7:
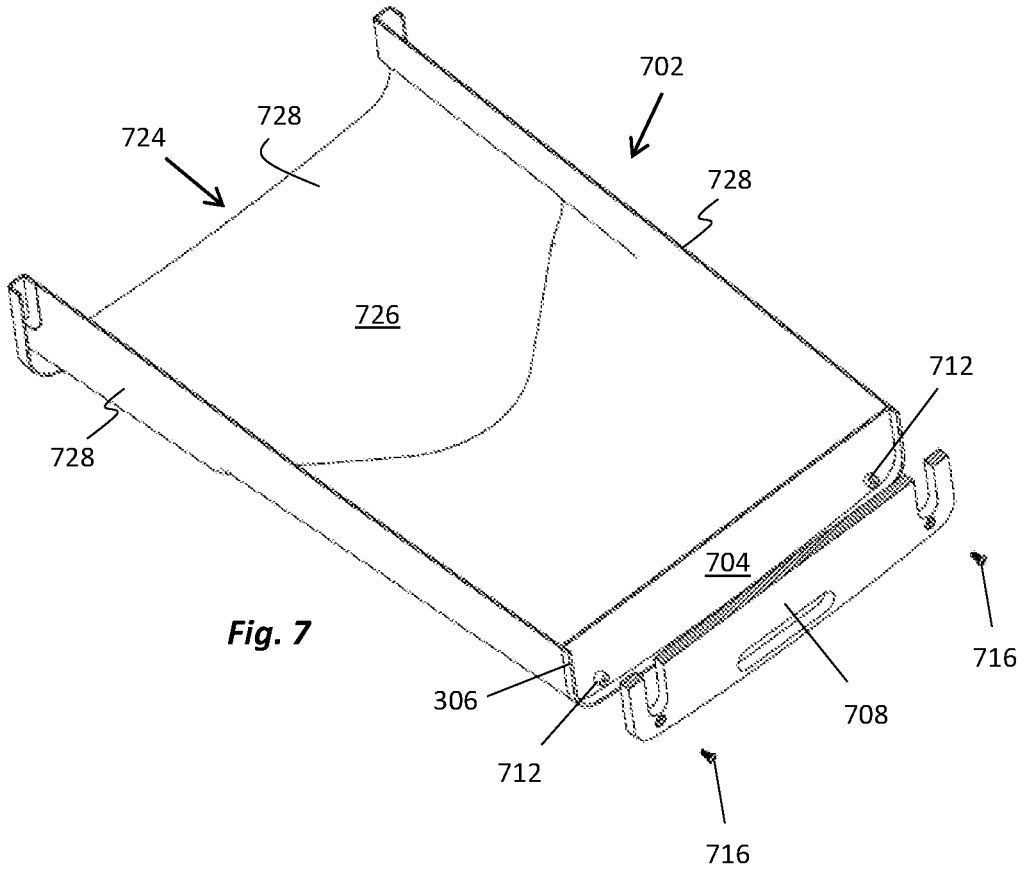
FIG. 7 illustrates an exploded, cross-sectional, bottom perspective view of one embodiment of a waste receptacle including an embodiment of a skid plate.
Figure 8:
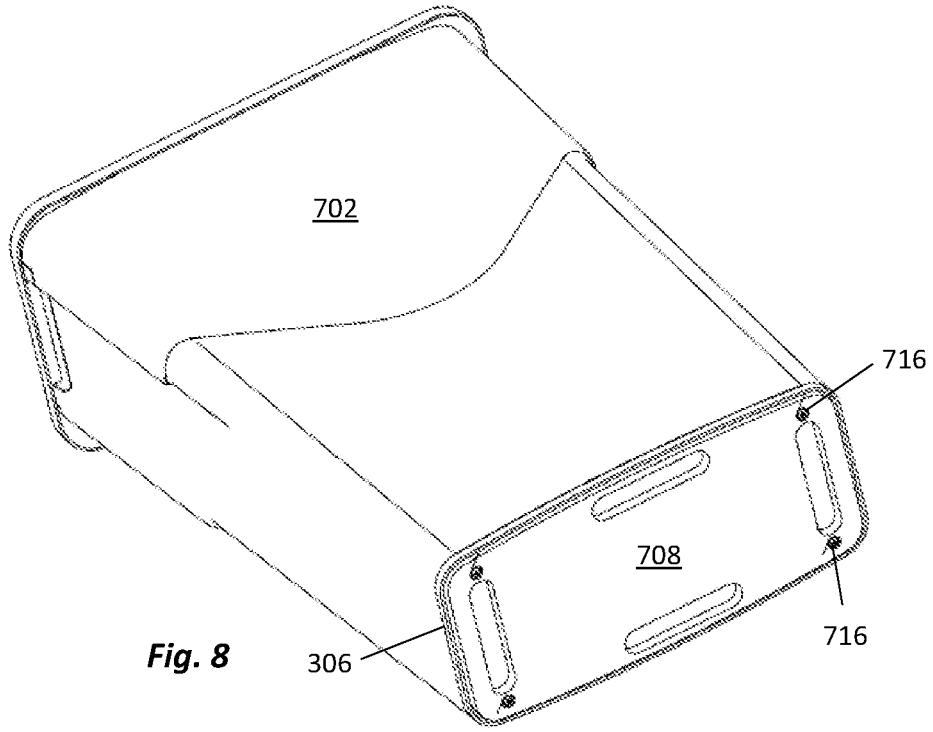
FIG. 8 illustrates a bottom perspective view of one embodiment of the waste receptacle and skid plate of FIG. 7.

With reference now to FIGS. 7 and 8, an alternate embodiment of a waste receptacle 702 includes a skirt 306 around the peripheral bottom edge of the bottom 704 of the waste receptacle 702 sized accommodate an alternate skid plate 708 held in place at least partially by a means for attaching the skid plate 708 to the receptacle 702. In the illustrated embodiment, the means for attaching includes a set of posts 712 formed into the bottom side of the waste receptacle 702 either located internal to the receptacle, or external to the receptacle as shown or both. The means for attaching also includes a set of fasteners 716 corresponding in number to and fastened to the set of posts 712. The fasteners can include nuts and bolts, screws, pins, automotive push connectors and the like.

Continued reference to FIGS. 7 and 8 also best illustrate an aspect of the waste receptacle 702 as including a top opening 724 into an internal space 726 defined by a side wall or side walls 728 and the enclosed bottom 704.

Figure 9:
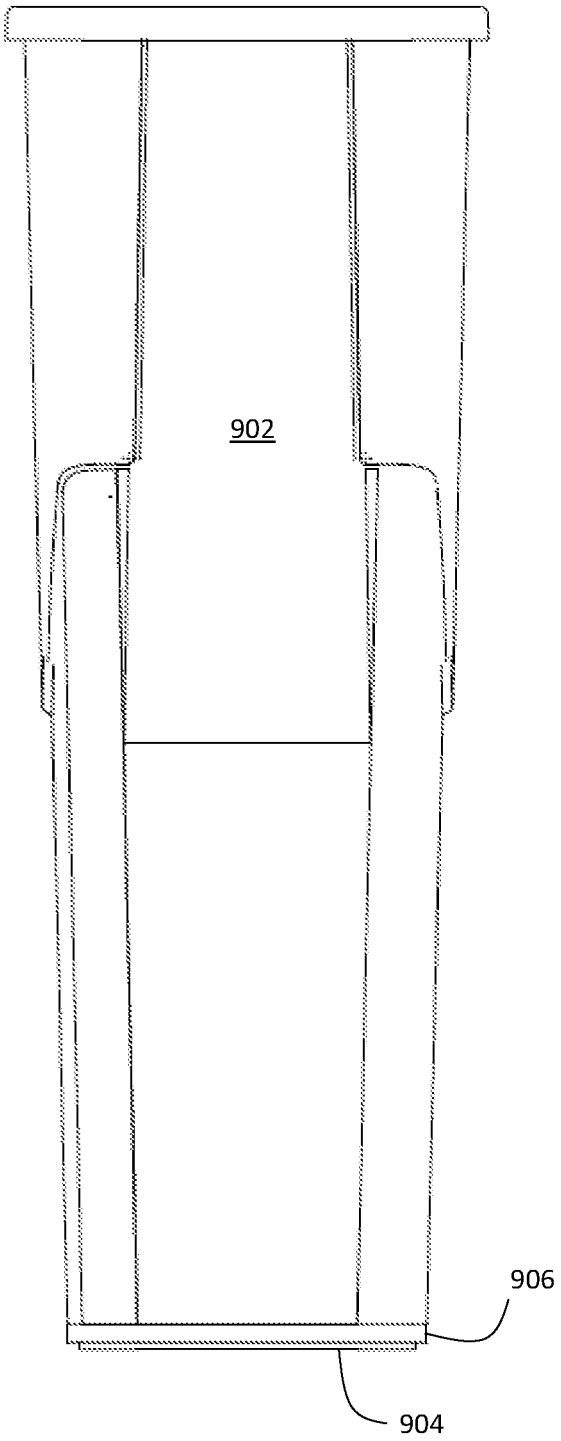
FIG. 9 illustrates a side plan view a waste receptacle and skid plate.

With reference now to FIG. 9, a side view of an exemplary waste receptacle 902 shows a skid plate 904 installed and extending slightly below the bottom edge of a skirt 906, or more generally, the bottom of the receptacle.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations, and/or additions to the present subject matter as would be readily apparent to one of ordinary skill in the art.

I claim:

1. A method comprising: providing a waste receptacle body including a top opening into a space defined by side walls and an enclosed bottom comprising a lower base; removably connecting a skid plate sized to cover the lower base where the skid plate includes grips sized to allow a user to lift the waste receptacle; observing wear on an exposed side of the skid plate over time; and removing and flipping the skid plate in response to the observed wear so that the exposed side is adjacent to the lower base.

2. The method as set forth in claim 1, where the removably connecting includes:

attaching one component of a snap together type fastener system to the lower base;

attaching another component of the snap together type fastener system to the skid plate; and aligning the skid plate and the lower base so that the snap together type fastener system engages and retains the skid plate on the lower base.

3. The method as set forth in claim 1, where the removably connecting includes:

inserting a rotatable, shaped turn key connected to the lower base through an opening through the skid plate where the opening is complimentarily shaped to the shaped turn key; and rotating the shaped turn key to engage and retain the skid plate in place on the lower base.

4. The method as set forth in claim 1, where the removably connecting includes connecting a fastener through the skid plate into a post formed into the bottom side of the waste receptacle.

5. A method comprising: providing a waste receptacle body, the waste receptacle body including a top opening into an interior space, the interior space defined by side walls and an enclosed bottom, the waste receptacle body further including exterior sides and an exterior base surrounded by a peripheral skirt; removably connecting a skid plate sized to cover the exterior base where the skid plate includes grips sized to allow a user to lift the waste receptacle; in response to observed wear on an exposed side of the skid plate over time, removing and flipping the skid plate so that the exposed side faces the exterior base within the peripheral skirt.

6. The method as set forth in claim 5, where the removably connecting includes:

attaching one component of a snap together type fastener system to the exterior base;

attaching another component of the snap together type fastener system to the skid plate; and aligning the skid plate and the exterior base so that the components of the snap together type fastener system engages and retains the skid plate on the exterior base.

7. The method as set forth in claim 5, where the removably connecting includes:

inserting a rotatable, shaped turn key connected to the exterior base through an opening through the skid plate where the opening is complimentarily shaped to the shaped turn key; and rotating the shaped turn key to engage and retain the skid plate in place on the exterior base.

8. The method as set forth in claim 5, where the removably connecting includes connecting a fastener through the skid plate into a post formed into the exterior base.

9. A waste receptacle comprising:

A waste receptacle body including an upper, open side and an opposed lower base where the lower base includes a skirt around a periphery of the lower base;

A rotatable, shaped turn key connected to the lower base; and

A skid plate sized to be removably received within the skirt around the periphery of the lower base and to cover the lower base within the skirt, the skid plate having an opening where the opening is complimentarily shaped to the shaped turn key such that the shaped turn key is insertable through the opening and when rotated, the shaped turn key engages and retains the skid plate in place on the lower base.

10. The waste receptacle as set forth in claim 9, where the skid plate comprises a radius edge around a periphery of the skid plate.

11. The waste receptacle as set forth in claim 9, where the skid plate comprises a beveled edge around a periphery of the skid plate.

12. The waste receptacle as set forth in claim 9, where the skid plate comprises grips sized to allow a user to lift the waste receptacle.

13. The waste receptacle as set forth in claim 9, where the skirt around the periphery of the lower base impedes lateral relative movement between the skid plate and the lower base.

* * * * *